US012071941B2

(12) United States Patent
Michel

(10) Patent No.: US 12,071,941 B2
(45) Date of Patent: Aug. 27, 2024

(54) TUBE RETENTION DEVICE FOR A ROLLER PUMP HEAD

(71) Applicant: LivaNova Deutschland GmbH, Munich (DE)

(72) Inventor: Günther Michel, Munich (DE)

(73) Assignee: LivaNova Deutschland GmbH, Munich (DE)

( * ) Notice: Subject to any disclaimer, the term of this patent is extended or adjusted under 35 U.S.C. 154(b) by 527 days.

(21) Appl. No.: 17/234,528

(22) Filed: Apr. 19, 2021

(65) Prior Publication Data

US 2021/0254614 A1 Aug. 19, 2021

Related U.S. Application Data

(63) Continuation of application No. PCT/EP2018/081939, filed on Nov. 20, 2018.

(51) Int. Cl.
*F04B 43/12* (2006.01)

(52) U.S. Cl.
CPC ..... *F04B 43/1261* (2013.01)

(58) Field of Classification Search
CPC ..... F04B 43/1261
See application file for complete search history.

(56) References Cited

U.S. PATENT DOCUMENTS 5,533,877 A * 7/1996 Friedmann ..... F04B 43/1253 417/477.1
8,047,819 B2 * 11/2011 Lawrence ..... F16L 3/1033 417/477.2

(Continued)

FOREIGN PATENT DOCUMENTS

EP 1241355 A2 9/2002
EP 2444669 A1 4/2012

(Continued)

OTHER PUBLICATIONS

EP Communication Pursuant for Article 94(3) EPC dated May 31, 2023 for European Application No. 18808273.9-1004.

(Continued)

*Primary Examiner* — Connor J Tremarche

(74) *Attorney, Agent, or Firm* — Seager, Tufte & Wickhem LLP

(57) ABSTRACT

A tube retention device includes first and second wall surfaces having a first attachment point and a second attachment point, respectively. A first clamp component, having a first tube-engagement surface, is pivotably coupled to the first wall surface at the first attachment point, and configured to rotate about an axis at least approximately normal to the first wall surface. A second clamp component, having a second tube-engagement surface, is pivotably coupled to the second wall surface at the second attachment point, and configured to rotate about an axis at least approximately normal to the second wall surface. The clamp components may be configured to rotate, in opposite directions and in response to application of force by a tube piece upon the tube-engagement surfaces, from an open position to a closed position, where the tube piece is retained between the clamp components when the clamp components are in the closed position.

20 Claims, 7 Drawing Sheets

(56) References Cited

U.S. PATENT DOCUMENTS

| | | | | |
|---|---|---|---|---|
| 2007/0080265 | A1 | 4/2007 | Schaffer | |
| 2015/0238677 | A1* | 8/2015 | Akita | A61M 60/37 417/63 |
| 2017/0312427 | A1* | 11/2017 | Steger | F16K 7/045 |
| 2018/0235393 | A1* | 8/2018 | Van Lieshout | F16B 2/10 |

FOREIGN PATENT DOCUMENTS

| | | | |
|---|---|---|---|
| EP | 2918838 | A1 | 9/2015 |
| FR | 3044379 | A1 | 6/2017 |

OTHER PUBLICATIONS

International Search Report and Written Opinion for International Application No. PCT/EP2018/081939 dated May 28, 2020.

* cited by examiner

TUBE RETENTION DEVICE FOR A ROLLER PUMP HEAD

CROSS REFERENCE TO RELATED APPLICATIONS

This application is a continuation of International Application No. PCT/EP2018/081939, filed Nov. 20, 2018, the disclosure of which is incorporated herein by reference.

TECHNICAL FIELD

The present disclosure relates to a tube retention device. More specifically, the disclosure relates to a tube retention device configured to retain hoses operatively coupled to roller pumps.

BACKGROUND

Roller pumps are utilized in medical technology, especially in heart-lung machines for the conveyance of blood in an artificial flow circuit. Generally, roller pumps include a pump head and a pump drive. The pump head includes a pump stator and a pump rotor. The pump stator is an essentially cylindrical hollow chamber wherein the inner wall thereof, which is designated as a pump bed, serves as a support for the tube piece which is inserted into the pump head and which lies against the inner wall. The pump rotor, which is rotatable about its central longitudinal axis, is arranged in the pump stator in such a manner that rollers, which are rotatably supported on a roller carrier, are rollable along the tube piece and thereby compress the tube piece against the inner wall of the stator. The compression of the tube piece can be adjusted by acting on an occlusion mechanism placed on the roller carrier, allowing the displacement of the rollers radially, inwardly for decreasing the compression (or the occlusion), or outwardly for increasing the compression (or the occlusion). The pump stator includes at least one open section for accommodating a tube piece, through which the tube piece exits the internal hollow chamber of the pump stator. To prevent wandering of the tube piece under the influence of the rollers of the pump rotor which are rolling thereon, at least one end of the tube piece must be fastened to the pump stator. For roller pumps with reversible running directions, it is necessary to fasten both ends of the tube piece.

Roller pumps us various types of fastening devices to retain the tube piece; for example, clamping elements integrated into the pump stator. With reference to FIG. 1, a conventional roller pump head 100 is illustrated, which includes a pump stator 102 and a pump rotor 104. The pump head 100 is configured such that a tube (not shown) can be inserted into the at least approximately cylindrical hollow chamber 106 of the pump stator in such a manner as to contact or lie against an inner wall 108 of the pump stator 102, which is designated as a pump bed. The rotatably supported rollers 120 of the pump rotor 104 roll along the tube piece and compress the latter against the inner wall 108 of the pump stator 102. The pump rotor 104 also includes an occlusion mechanism 105 configured to facilitate adjustment of the position of the roller 120. In response to the compression, the medium (e.g., blood) that is present in the tube piece is conducted in the direction of rotation of the pump rotor 104.

The pump stator 102 includes an opening 122 to facilitate insertion of the tube piece. A tube retention mechanism 124 is disposed at the opening 122, and is configured for retaining the tube at two locations. The tube retention mechanism 124 is detachable from the pump stator 102. In the illustrated embodiment, the tube retention mechanism 124 includes a block 126 having a lower portion 128 and an upper portion 130 that are configured to be brought together to enclose a tube within two apertures 132 formed within the block 126, and are held together by a fastening device 134. In other embodiments, the block may include receptacles for fastening devices such as those described in U.S. Pat. No. 5,533,877, assigned to Sorin Group Deutschland GmbH, of Germany. These conventional devices require multiple steps and removal of components to insert and remove a tube piece.

SUMMARY

Embodiments of the subject matter disclosed herein include tube retention devices configured to facilitate inserting and removing a tube piece by relatively simple operations, as compared with the conventional devices described above.

Embodiments include a tube retention device that includes a first wall surface and a second wall surface, the first and second wall surfaces including a first attachment point and a second attachment point, respectively. A first clamp component, having a first tube-engagement surface, may be pivotably coupled to the first wall surface at the first attachment point, where the first clamp component may be configured to rotate about an axis at least approximately normal to the first wall surface at the first attachment point. A second clamp component, having a second tube-engagement surface, may be pivotably coupled to the second wall surface at the second attachment point, where the second clamp component may be configured to rotate about an axis at least approximately normal to the second wall surface at the second attachment point. In embodiments, the first and second clamp components may be configured to rotate, in opposite directions and in response to application of force by a tube piece upon the first and second tube-engagement surfaces, from an open position to a closed position, where the tube piece is retained between the first and second clamp components when the first and second clamp components are in the closed position.

Embodiments include a tube retention device, including a tube retention block having a first wall surface and a second wall surface, the first and second wall surfaces including a first attachment point and a second attachment point, respectively. In embodiments, the tube retention device may include a first clamp component, having a first tube-engagement surface and a first pivot couple surface, where the first pivot couple surface is configured to engage a first pivot pin, and where the first pivot pin is coupled to the first attachment point such that the first clamp component is configured to rotate about the first pivot pin. Embodiments of the tube retention device may further include a second clamp component having a second tube-engagement surface and a second pivot couple surface, where the second pivot couple surface is configured to engage a second pivot pin, and where the second pivot pin is coupled to the second attachment point such that the second clamp component is configured to rotate about the second pivot pin. In embodiments, the first clamp component may be configured to rotate, in a first direction and in response to application of force by a portion of a tube piece upon the first tube-engagement surface, from an open position to a closed position, and the second clamp component may be configured to rotate, in a second direction that is opposed to the first direction and in response to application of force by the portion of the tube piece upon the second tube-engagement surface, from an open position to a closed position. In embodiments, the portion of the tube piece may be retained between the first and second clamp components when the first and second clamp components are in the closed position.

Embodiments further include a roller pump, including a pump head having an opening defined therein; and a tube retention device disposed at the opening. In embodiments, the tube retention device may include a first wall surface, a second wall surface, a third wall surface, and a fourth wall surface, the first, second, third, and fourth wall surfaces including a first attachment point, a second attachment point, a third attachment point, and a fourth attachment point, respectively. The tube retention device may further include a first clamp component having a first tube-engagement surface, where the first clamp component is pivotably coupled to the first wall surface at the first attachment point, and where the first clamp component is configured to rotate about an axis at least approximately normal to the first wall surface at the first attachment point; a second clamp component having a second tube-engagement surface, where the second clamp component is pivotably coupled to the second wall surface at the second attachment point, and where the second clamp component is configured to rotate about an axis at least approximately normal to the second wall surface at the second attachment point. The first and second clamp components may be configured to rotate, in opposite directions and in response to application of force by a tube piece upon the first and second tube-engagement surfaces, from an open position to a closed position, where the tube piece is retained between the first and second clamp components when the first and second clamp components are in the closed position. Embodiments of the tube retention device may further include a third clamp component having a third tube-engagement surface and a third pivot couple surface, where the third pivot couple surface is configured to engage a third pivot pin, where the third pivot pin is coupled to the third attachment point such that the third clamp component is configured to rotate about the third pivot pin; and a fourth clamp component having a fourth tube-engagement surface and a fourth pivot couple surface, where the fourth pivot couple surface is configured to engage a fourth pivot pin, where the fourth pivot pin is coupled to the fourth attachment point such that the fourth clamp component is configured to rotate about the fourth pivot pin, and where the third and fourth clamp components are configured to rotate, in opposite directions and in response to application of force by an additional portion of the tube piece upon the third and fourth tube-engagement surfaces, from an open position to a closed position. The additional portion of the tube piece may be retained between the third and fourth clamp components when the third and fourth clamp components are in the closed position.

While multiple embodiments are disclosed, still other embodiments of the presently disclosed subject matter will become apparent to those skilled in the art from the following detailed description, which shows and describes illustrative embodiments of the disclosed subject matter. Accordingly, the drawings and detailed description are to be regarded as illustrative in nature and not restrictive.

Figure 1:
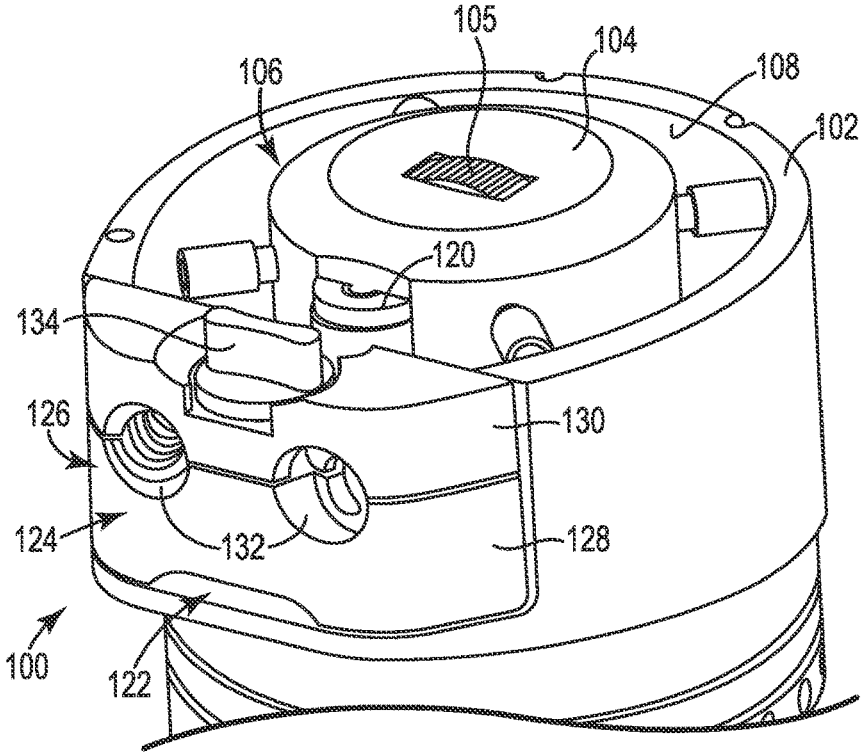
Fig. 1 PRIOR ART
FIG. 1 is a perspective view of a conventional roller pump head.

While the disclosed subject matter is amenable to various modifications and alternative forms, specific embodiments have been shown by way of example in the drawings and are described in detail below. The intention, however, is not to limit the subject matter disclosed herein to the particular embodiments described. On the contrary, the disclosure is intended to cover all modifications, equivalents, and alternatives falling within the scope of the subject matter disclosed herein, and as defined by the appended claims.

As used herein in association with values (e.g., terms of magnitude, measurement, and/or other degrees of qualitative and/or quantitative observations that are used herein with respect to characteristics (e.g., dimensions, measurements, attributes, components, etc.) and/or ranges thereof, of tangible things (e.g., products, inventory, etc.) and/or intangible things (e.g., data, electronic representations of currency, accounts, information, portions of things (e.g., percentages, fractions), calculations, data models, dynamic system models, algorithms, parameters, etc.), "about" and "approximately" may be used, interchangeably, to refer to a value, configuration, orientation, and/or other characteristic that is equal to (or the same as) the stated value, configuration, orientation, and/or other characteristic or equal to (or the same as) a value, configuration, orientation, and/or other characteristic that is reasonably close to the stated value, configuration, orientation, and/or other characteristic, but that may differ by a reasonably small amount such as will be understood, and readily ascertained, by individuals having ordinary skill in the relevant arts to be attributable to measurement error; differences in measurement and/or manufacturing equipment calibration; human error in reading and/or setting measurements; adjustments made to optimize performance and/or structural parameters in view of other measurements (e.g., measurements associated with other things); particular implementation scenarios; imprecise adjustment and/or manipulation of things, settings, and/or measurements by a person, a computing device, and/or a machine; system tolerances; control loops; machine-learning; foreseeable variations (e.g., statistically insignificant variations, chaotic variations, system and/or model instabilities, etc.); preferences; and/or the like.

The terms "up," "upper," and "upward," and variations thereof, are used throughout this disclosure for the sole purpose of clarity of description and are only intended to refer to a relative direction (i.e., a certain direction that is to be distinguished from another direction), and are not meant to be interpreted to mean an absolute direction. Similarly, the terms "down," "lower," and "downward," and variations thereof, are used throughout this disclosure for the sole purpose of clarity of description and are only intended to refer to a relative direction that is at least approximately opposite a direction referred to by one or more of the terms "up," "upper," and "upward," and variations thereof.

DETAILED DESCRIPTION

Figure 2A:
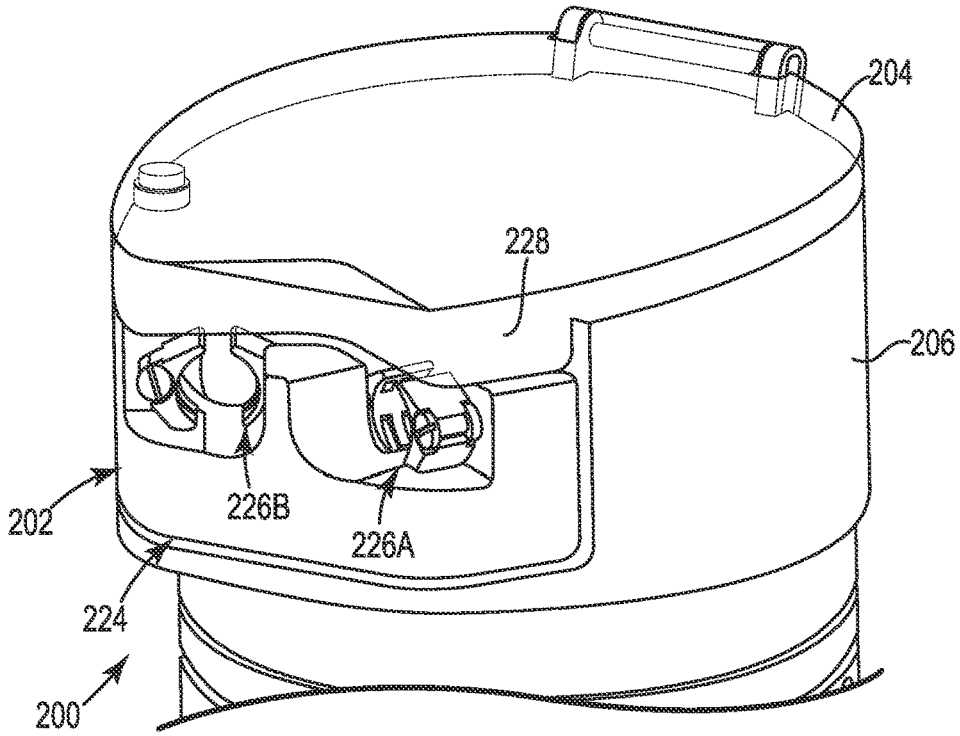
FIG. 2A is a perspective view of an illustrative roller pump head having a tube retention device, in accordance with embodiments of the subject matter disclosed herein.

Embodiments of the subject matter disclosed herein include tube retention devices for roller pumps that are configured to facilitate inserting and removing a tube piece by pressing, manually, the tube piece into place and lifting the tube piece out of engagement with the tube retention device. In this manner, embodiments of the subject matter disclosed herein facilitate more quickly attaching and removing tube pieces to roller pump heads, as compared with the prior devices such as those described above. FIG. 2A depicts an illustrative roller pump head 200 having a tube retention device 202, in accordance with embodiments of the subject matter disclosed herein. According to embodiments, the tube retention device 202 may be configured to be associated with a roller pump such as, for example, a roller pump associated with a heart-lung machine. However, embodiments of the tube retention device 202 may be utilized in any number of different contexts in which a tube piece or other at least approximately cylindrical object is to be retained. As shown, the roller pump head 200 may include a lid 204 configured to be pivotably disposed over the top of a pump stator 206.

Figure 2B:
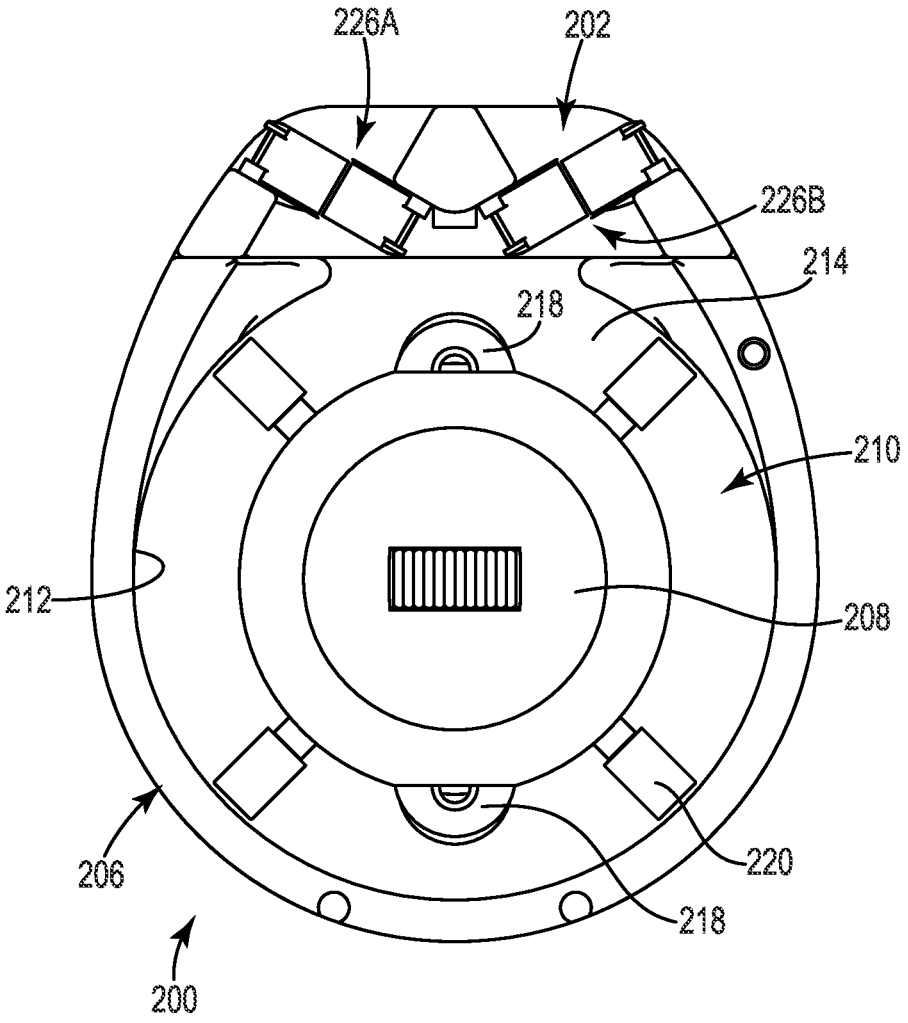
FIG. 2B is a top view of the illustrative roller pump head depicted in FIG. 2A, with the cover (the lid) removed, in accordance with embodiments of the subject matter disclosed herein.
Figure 2C:
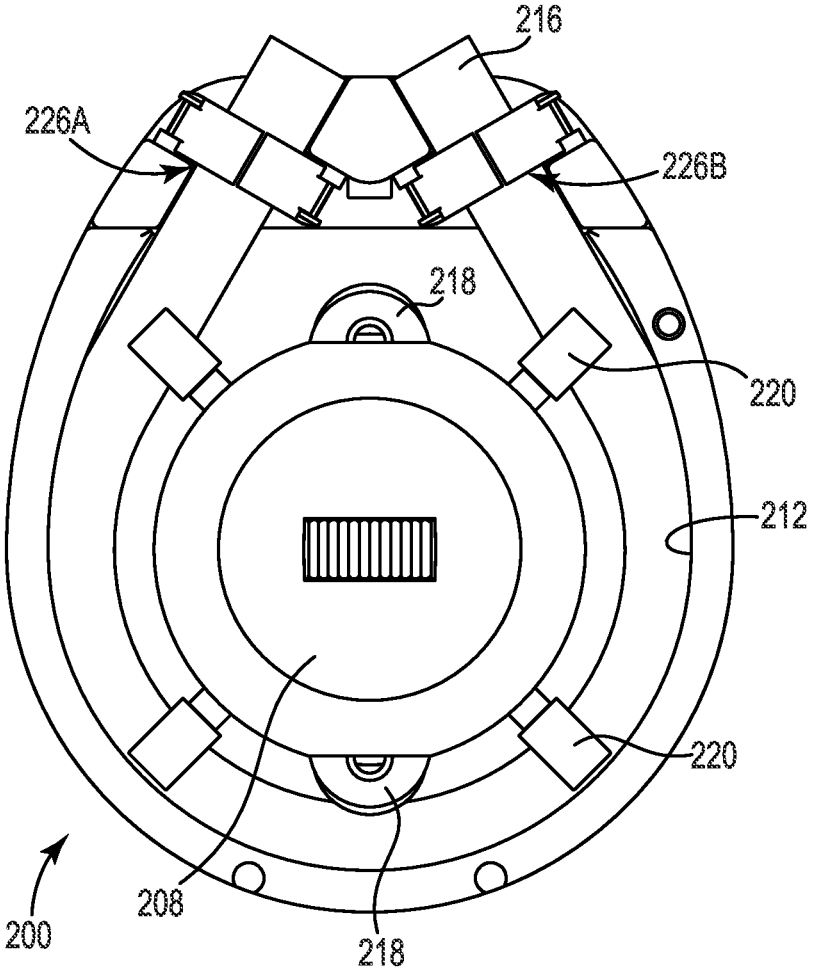
FIG. 2C is a top view of the illustrative roller pump head depicted in FIGS. 2A and 2B, with the cover removed and a tube piece inserted, in accordance with embodiments of the subject matter disclosed herein.

FIGS. 2B and 2C depict top views of the illustrative roller pump head 200, in which the lid 204 has been removed. As shown in FIGS. 2B and 2C, for example, the illustrative roller pump head 200 further includes a pump rotor 208 disposed within the pump stator 206. The pump stator 206 includes a chamber 210 defined therein, and bounded (at least peripherally) by an inner wall 212 of the pump stator 206. A lower wall 214 may form a lower bound of the chamber 210, and a lower side (not shown) of the lid 204 may form an upper bound to the chamber 210. The chamber 210 may be, due to the curvature of the inner wall 212, at least approximately cylindrical in shape.

As shown in FIG. 2C, the pump head 200 is configured such that a tube piece 216 can be inserted into the chamber 210 in such a manner as to contact or lie against the inner wall 212. The inner wall 212 may be referred to, in embodiments, as a pump bed. The roller pump rotor 208 also includes rotatably supported rollers 218 configured to roll along the tube piece 216, thereby compressing the tube piece 216 against the inner wall 212 of the pump stator 206. In response to the compression, the fluid (e.g., blood) present in the tube piece 216 is conducted in the direction of rotation of the pump rotor 208. In embodiments, as shown in FIGS. 2B and 2C, the rotor pump 208 may also include one or more roller guides 220 extending radially from the pump rotor 208 and configured to be positioned above and below the tube piece 216, thereby keeping the tube piece aligned to the inner wall 212 of the pump stator 206.

An opening 224 defined in the pump stator 206 may be configured to facilitate insertion of a tube piece 216 into the pump head 200. The tube retention device 202 is configured to be inserted within the opening 224 in the pump stator 206. In embodiments, the tube retention device 202, or any of its components, may be configured to be removeably disposed in the opening 224. According to embodiments, the tube retention device 202 and the pump stator 206 may be integrated as a single piece to which the clamps 226A and 226B (described below) may be removeably mounted. Any number of mechanisms may be used to removeably secure the tube retention device 202, or any of its components, within the opening 224 including, for example, an interference fit mechanism, clips, corresponding posts and apertures, spring plates, and/or the like.

In operation, as shown in FIG. 2C, a tube piece 216 may be inserted into the pump bed and fastened or fixed in position with the aid of tube clamps 226A and 226B. In embodiments, the detachable construction of the tube retention device 202, or any of its components (such as tube clamps 226A and 226B), facilitates an exchange of this module by another tube fastening device, so that different tube clamps can be employed on the same pump head, for accommodating tubing of different diameters. To use different tube sizes, it is not needed to remove the whole retention device 202. The four clamp components as shown, for instance, in FIGS. 3A 3B (330, 332, 346, and 348) can be replaced by snapping/unsnapping them on the pivot pins 338/344 and 356/362, and replacing with clamp components designed to work with different tube diameters. According to embodiments, a tube piece 216 may be caused to be engaged by, and thus retained by, the tube clamps 226A and 226B by pushing the tube piece 216 downward onto the tube clamps 226A and 226B, and removed by pulling the tube piece 216 upward out of the tube clamps 226A and 226B. In embodiments, as shown in FIG. 2A, the lid 204 may include a wall 228 extending downward and configured to engage the tube clamps 226A and 226B, thereby preventing the tube clamps 226A and 226B from opening while the lid 204 is closed. In embodiments, the pump may include a safety mechanism that prevents the pump from operating as long as the lid 204 is not closed. For example, a sensor system may be used to detect whether the lid 204 is closed. A closed lid 204 may be used to further indicate that the tube clamps 226A and 226B are also in the closed position. According to embodiments, the sensor system may include any number of different types of sensors such as, for example, mechanical sensors, electrical sensors, optical sensors, and/or the like.

The illustrative pump head 200 and tube retention device 202 shown in FIGS. 2A-2C are not intended to suggest any limitation as to the scope of use or functionality of embodiments of the present disclosure. The illustrative pump head 200 and tube retention device 202 should not be interpreted as having any dependency or requirement related to any single component or combination of components illustrated therein. Additionally, various components depicted in FIGS. 2A-2C may be, in embodiments, integrated with various ones of the other components depicted therein (and/or components not illustrated), all of which are considered to be within the ambit of the subject matter disclosed herein.

Figure 3A:
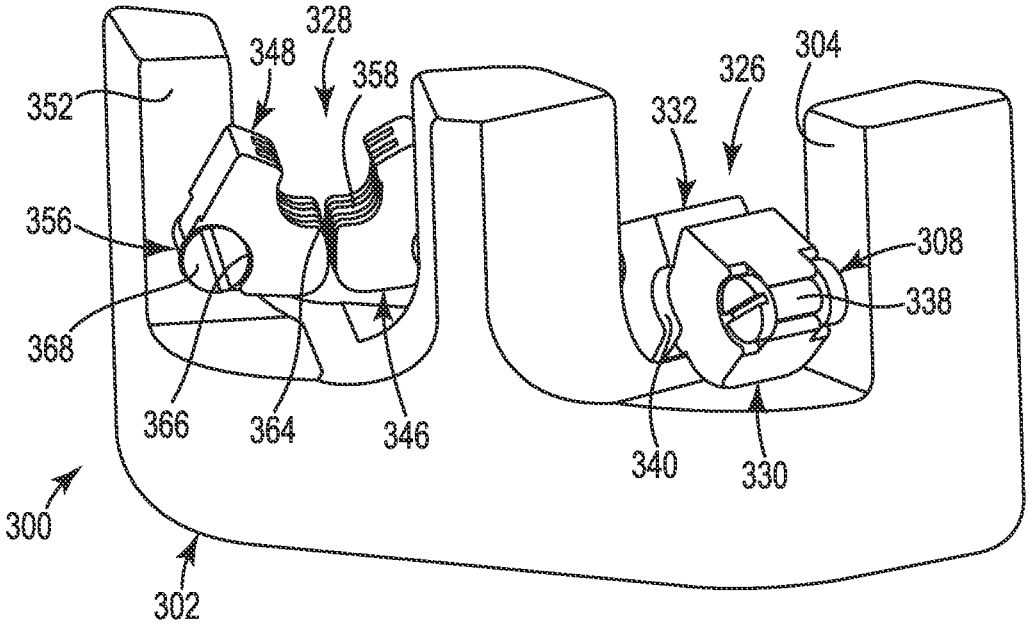
FIG. 3A is a front perspective view of an illustrative tube retention device, as seen from the outside of a roller pump head in which the tube retention device may be removably disposed, in accordance with embodiments of the subject matter disclosed herein.
Figure 3B:
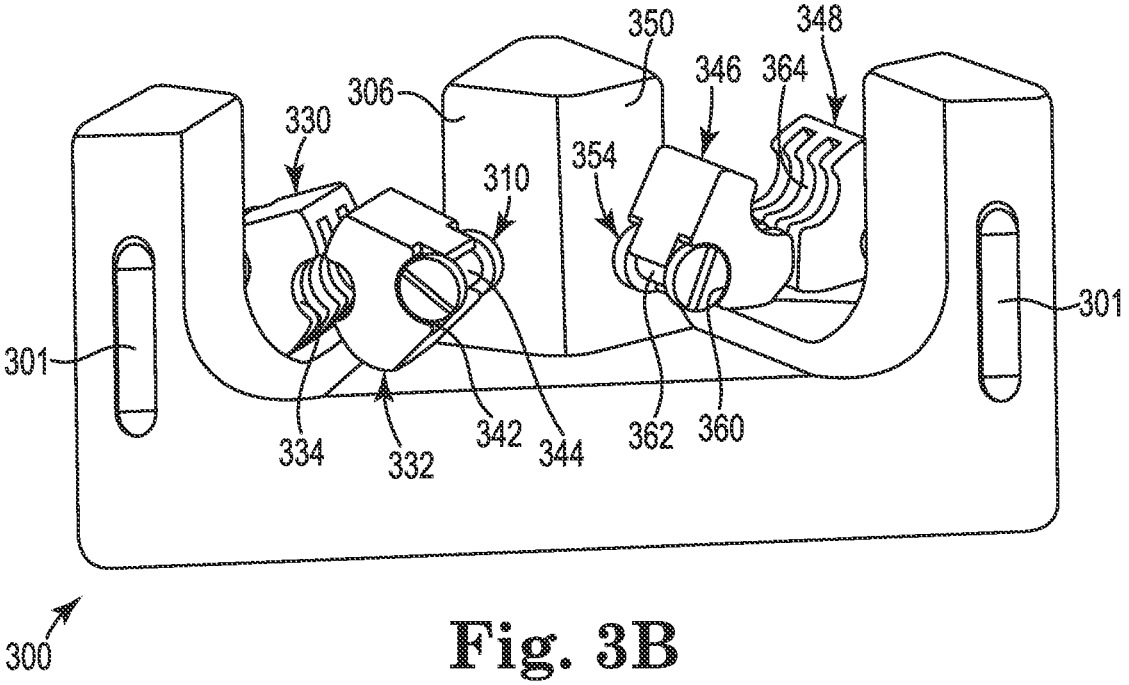
FIG. 3B is a rear perspective view of the illustrative tube retention device depicted in FIG. 3A, as seen from the inside of the roller pump head in which the tube retention device may be removably disposed, in accordance with embodiments of the subject matter disclosed herein.
Figure 3C:
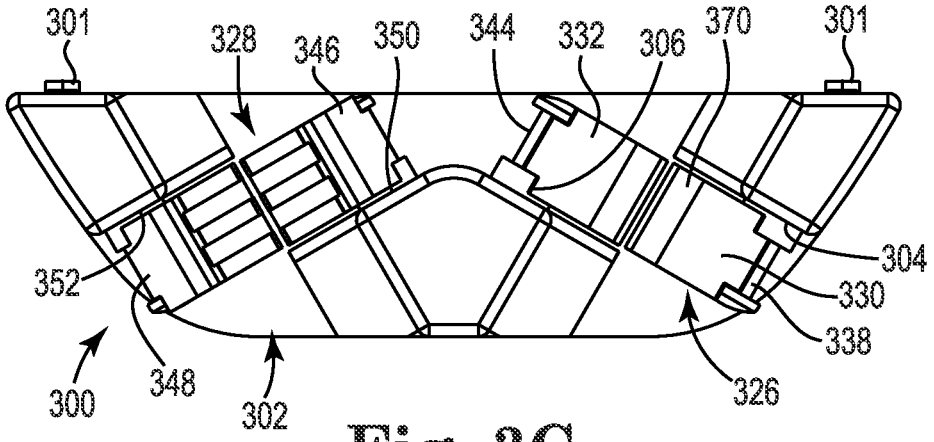
FIG. 3C is a top view of the illustrative tube retention device depicted in FIGS. 3A and 3B, in accordance with embodiments of the subject matter disclosed herein.
Figure 3D:
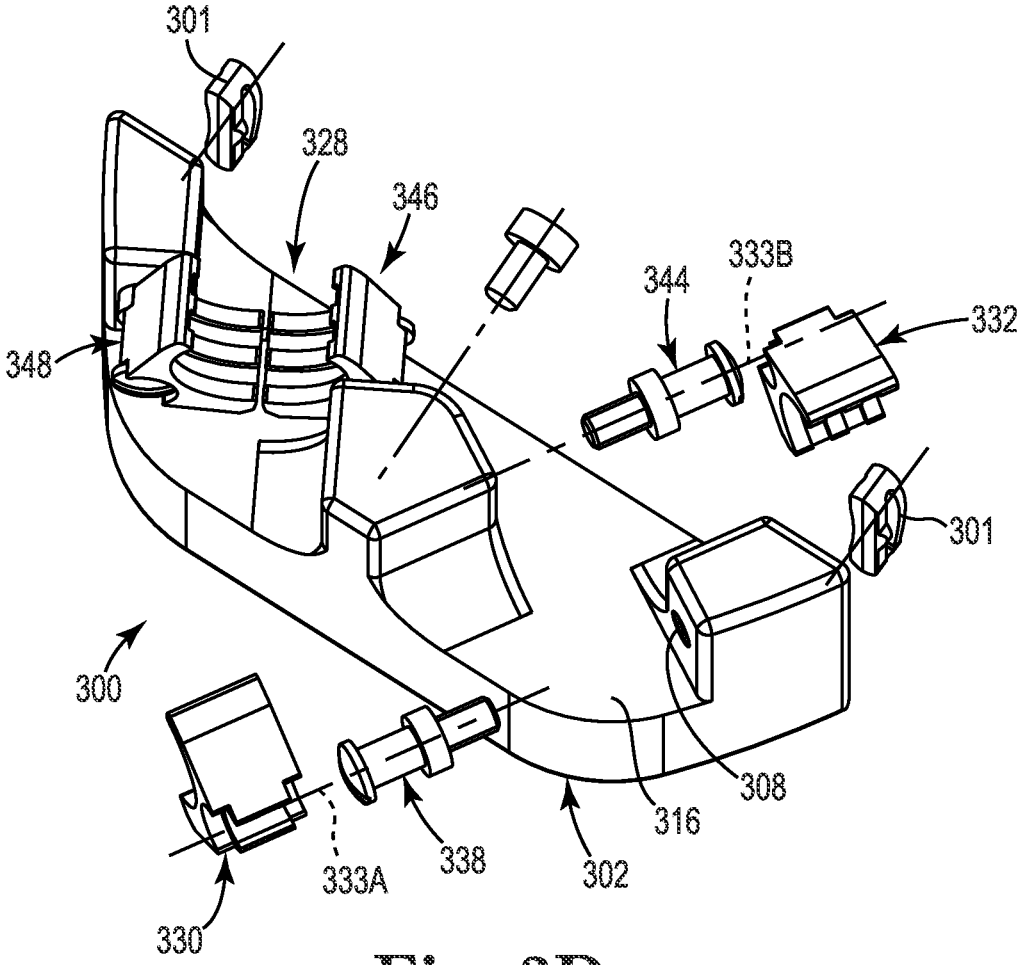
FIG. 3D is a partially-exploded front perspective view of the tube retention device depicted in FIGS. 3A-3C, in accordance with embodiments of the subject matter disclosed herein.

FIG. 3A is a front perspective view of an illustrative tube retention device 300, as seen from the outside of a roller pump in which the tube retention device 300 may be removably disposed, in accordance with embodiments of the subject matter disclosed herein. FIG. 3B is a rear perspective view of the illustrative tube retention device 300, as seen from the inside of the roller pump in which the tube retention device 300 may be removably disposed; and FIG. 3C is a top view of the tube retention device 300, in accordance with embodiments of the subject matter disclosed herein. FIG. 3D is a partially-exploded front perspective view of the tube retention device 300 depicted in FIGS. 3A-3C, in accordance with embodiments of the subject matter disclosed herein. According to embodiments, the tube retention device 300 may be, or be similar to, the tube retention device 202 depicted in FIGS. 2A-2C. The tube retention device 300 may be configured to be removably disposed in an opening of a stator of a roller pump head, such as, for example, is depicted in FIGS. 2A-2C. Any number of mechanisms may be used to removeably secure the tube retention device 202 within the opening 224 including, for example, an interference fit mechanism, clips, corresponding posts and apertures, spring plates, and/or the like. For example, as shown in FIGS. 3B, 3C, and 3D, the tube retention device 300 may include spring plates 301 configured to deform upon engagement with a mounting feature (not shown) disposed within the roller pump head, so as to stabilize a position of the tube retention device 300, hold the tube retention device 300 in place, and/or the like.

Figure 3E:
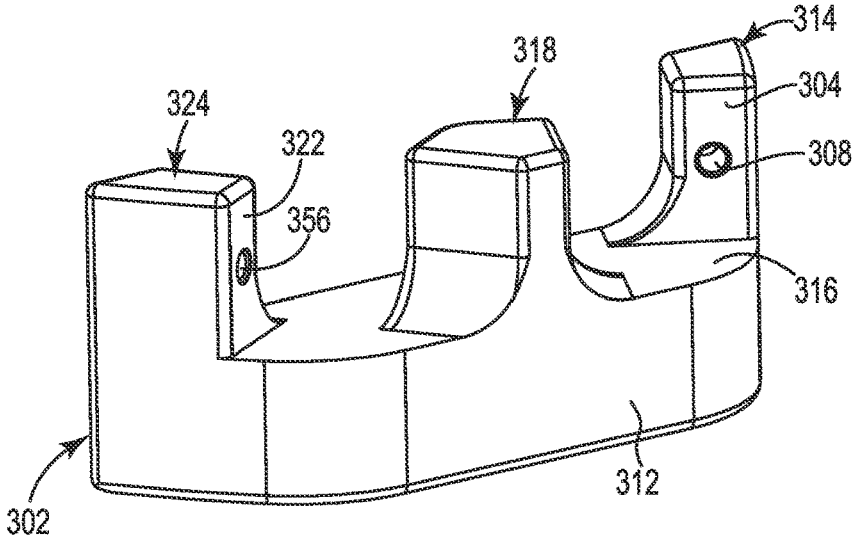
FIG. 3E is a front perspective view of the illustrative tube retention block depicted in FIGS. 3A-3D, as seen from the outside of the roller pump head in which the tube retention device may be removably disposed, in accordance with embodiments of the subject matter disclosed herein.
Figure 3F:
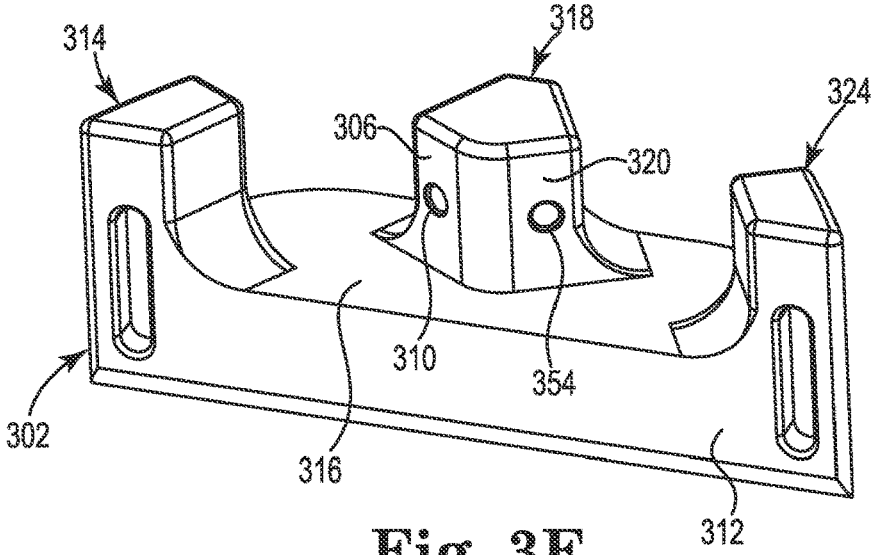
FIG. 3F is a rear perspective view of the illustrative tube retention block depicted in FIG. 3E, as seen from the inside of the roller pump head in which the tube retention device may be removably disposed, in accordance with embodiments of the subject matter disclosed herein.

As shown in FIGS. 3A and 3B, the tube retention device 300 includes a tube retention block 302 having a first wall surface 304 and a second wall surface 306, the first and second wall surfaces 304 and 306 including a first and second attachment point 308 and 310, respectively. As shown in FIGS. 3E and 3F, which are front and rear perspective views of the tube retention block 302, respectively, the tube retention block 300 may include a base 312 configured to be disposed within an opening of a pump head of a roller pump. As shown, the first wall surface 304 may be disposed on a first pillar 314 extending upward from an upper surface 316 of the base 312, and the second wall surface 306 may be disposed on a second pillar 318 extending upward from the upper surface 316 of the base 312. Additionally, as shown, in embodiments in which the tube retention device is configured to retain a tube piece in two locations, the second pillar 318 may include a third wall surface 320, while a fourth wall surface 322 may be disposed on a third pillar 324.

As shown in FIGS. 3A-3D, the tube retention device 300 may include a first clamp 326 and a second clamp 328. According to embodiments, a tube retention device may include one clamp, two clamps (such as tube retention device 300), or more than two clamps (e.g., in a tube retention device, not shown, configured to removably secure more than one tube piece). In the illustrated embodiments, the first clamp 326 includes a first clamp component 330 and a second clamp component 332, which are pivotably coupled to the first and second wall surfaces 304 and 306, respectfully, at the attachment points 308 and 310, respectively. In embodiments, the first and second clamp components 330 and 332 may each be configured to rotate about a respective axis 333A and 333B (shown in FIG. 3D). The axes 333A and 333B may be at least approximately normal to the first and second wall surfaces, respectively, and may, in embodiments, be at least approximately parallel to one another.

Figure 3G:
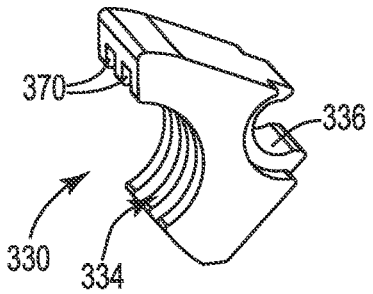
FIGS. 3G-3H are front perspective views of one of the illustrative clamp components of the clamps depicted in FIGS. 3A-3D, in accordance with embodiments of the subject matter disclosed herein.
Figure 3H:
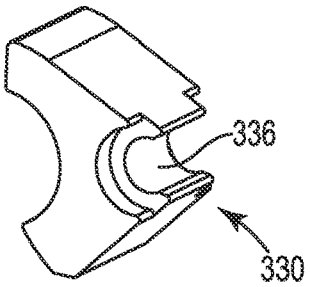

The first clamp component 330, which is also depicted, for example, in FIGS. 3G and 3H, includes a first tube-engagement surface 334 and a first pivot couple surface 336. In embodiments, the first pivot couple surface 336 is configured to engage a first pivot pin 338, wherein the first pivot pin 338 is coupled to the tube retention block 302 at the first attachment point 308 such that the first clamp component 330 is configured to rotate about the first pivot pin 338. As shown, for example, in FIGS. 3E and 3F, attachment points (e.g., attachment points 308 and 310) may include apertures configured to receive pivot pins (e.g., pivot pin 338).

The second clamp component 332 includes a second tube-engagement surface 340 and a second pivot couple surface 342, where the second pivot couple surface 342 is configured to engage a second pivot pin 344. The second pivot pin 344 may be coupled to the tube retention block 302 at the second attachment point 310 such that the second clamp component 332 is configured to rotate about the second pivot pin 344. In this manner, the first and second clamp components 330 and 332 may form the first clamp 326 and may be configured to rotate in opposite directions and toward one another, from an open position to a closed position, in response to a tube piece being pushed down onto the clamp 326 (as shown, for example, in FIGS. 5A and 5B, described below).

Similarly, the second clamp 328 may include a third clamp component 346 and a fourth clamp component 348, which are pivotably coupled to a third and fourth wall surfaces 350 and 352, respectively, at the third and fourth attachment points 354 and 356, respectively. The third clamp component 346 includes a third tube-engagement surface 358 and a third pivot couple surface 360. In embodiments, the third pivot couple surface 360 is configured to engage a third pivot pin 362, wherein the third pivot pin 362 is coupled to the third attachment point 354 such that the third clamp component 346 is configured to rotate about the third pivot pin 362.

The fourth clamp component 348 includes a fourth tube-engagement surface 364 and a fourth pivot couple surface 366, where the fourth pivot couple surface 366 is configured to engage a fourth pivot pin 368. The fourth pivot pin 366 may be coupled to the fourth attachment point 356 such that the fourth clamp component 348 is configured to rotate about the fourth pivot pin 368. In this manner, the third and fourth clamp components 346 and 348 may form the second clamp 328 and may be configured to rotate in opposite directions and toward one another, from an open position to a closed position, in response to a tube piece being pushed down onto the clamp 328. To remove the tube piece, the tube piece may be pulled upwards, causing the clamp components 346 and 348 to rotate away from one another, from the second position to the first position.

According to embodiments, the tube-engagement surfaces 334, 340, 358, and 364 may include any number of different types of features such as, for example, grip features configured to facilitate maintaining a grip on a tube piece (that is, e.g., by creating a friction interface between the tube piece and the tube-engagement surface). Grip features may include rough surfaces, bumps, ridges, grooves, rubber and/or rubber-like materials, and/or the like. For example, embodiments include a number of grooves 370 defined in a tube-engagement surface 334, as shown, for example, in FIG. 3G. In embodiments, the first and second tube-engagement surfaces 334 and 340 may interface with one another to form a retention interface that extends at least approximately around the entire perimeter of the retained portion of the tube piece. In embodiments, for example, the grooves may be configured (e.g. sufficiently pronounced or deep) to facilitate an interlacing of the tube-engagement surface 334 with the tube-engagement surface 340 of the corresponding clamp component 332.

In embodiments, the first and/or second tube retention clamps 326 and/or 328 may be associated with a limit stop configured to prevent at least one of the first and second clamp components 330 and 332, and/or at least one of the third and fourth clamp components 346 and 348, respectively, from rotating further than a closed position (and/or an open position). In embodiments, for example, as shown in FIG. 2A (and as explained above, in connection therewith), a roller pump may include a lid 204 having a wall 228 extending downward and configured to engage the clamps 226A and 226B, thereby preventing the clamps from opening while the lid 204 is closed. In embodiments, the pump may include a safety mechanism that prevents the pump from operating as long as the lid 204 is not closed. In embodiments, the lid 204 may also only be closed when both clamps 226A and 226B are in the closed position.

According to embodiments, a position-maintaining mechanism may be utilized to maintain the components of a clamp in an open position until acted upon by the tube piece or other force. In embodiments, a first position-maintaining mechanism may be utilized with respect to a first clamp, while a second position-maintaining mechanism is utilized with respect to a second clamp. In some embodiments, a single position-maintaining mechanism may be used for more than one clamp. The position-maintaining mechanism may include a friction interface, a spring, a lock, and/or the like. According to embodiments, a locking mechanism may be used to lock one or more clamp components in an open position, closed position, and/or the like. In embodiments, the limit stop may include a protrusion extending from a surface of the tube retention block 302, a surface of one of the clamp components, and/or the like. In embodiments, the limit stop may include the upper surface 316 (see FIG. 3D) of the tube retention block 302 such that, for example, when a clamp component rotates downward, toward the upper surface 316 of the tube retention block 302, a lower-most surface of the clamp may be configured to engage the upper surface 316, thereby preventing the clamp component from rotating any further in that direction. In embodiments, the clamp components of each clamp may be configured to rotate independently, while, in embodiments, the clamp components of one or more of the clamps may be configured to rotate simultaneously with the other clamp or clamps. For example, in embodiments, a guide system may be coupled to the two components of a clamp and configured to synchronize rotation of the clamps.

Figure 4:
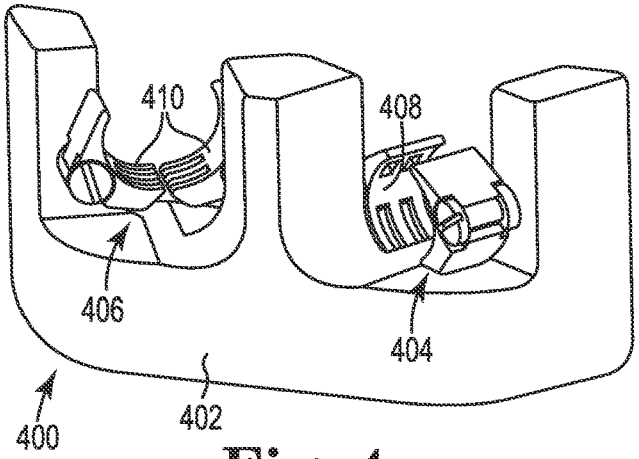
FIG. 4 is a front perspective view depicting another illustrative tube retention device, as seen from the outside of a roller pump head within which the tube retention device may be configured to be disposed, in accordance with embodiments of the subject matter disclosed herein.

According to embodiments, the tube-engagement surfaces 334, 340, 358, and 364 may be configured in any number of different manners such as, for example, by being designed to have a curve that corresponds to a curve of an outside surface of a tube piece of a certain diameter or range of diameters. In this manner, for example, a number of different tube retention devices may be provided and, alternately, disposed within an opening of a pump, depending upon the diameter of tube that is to be used. For example, FIG. 4 is a front perspective view depicting another illustrative tube retention device 400, from outside a roller pump head within which the tube retention device 400 may be configured to be disposed, in accordance with embodiments of the subject matter disclosed herein. The tube retention device 400 may be similar to the tube retention device 300 depicted in FIGS. 3A and 3B, the tube retention device 202 depicted in FIGS. 2A-2C, and/or the like. As shown in FIG. 4, the tube retention device 400 includes a tube retention block 402 that supports clamps 404 and 406, which are designed to be used with a tube piece having a larger diameter than the tube piece for which clamps 326 and 328 (depicted in FIGS. 3A-3D) are configured to be used, as can be seen by the larger curves on the tube-engagement surfaces 408 and 410 of the clamps 404 and 406, respectively. As described above, it is not needed to remove the whole retention device 400 to use different tube sizes. The parts no. 302 and 402 are the same, just the clamp parts need to be changed with tubes of different sizes (but it is, of course, possible to change the whole assembly not only the clamps).

The illustrative tube retention device 300 shown in FIGS. 3A-3H and the illustrative tube retention device 400 shown in FIG. 4 are not intended to suggest any limitation as to the scope of use or functionality of embodiments of the present disclosure. The illustrative tube retention devices 300 and 400 should not be interpreted as having any dependency or requirement related to any single component or combination of components illustrated therein. Additionally, various components depicted in FIGS. 3A-3H and 4 may be, in embodiments, integrated with various ones of the other components depicted therein (and/or components not illustrated), all of which are considered to be within the ambit of the subject matter disclosed herein.

Figure 5A:
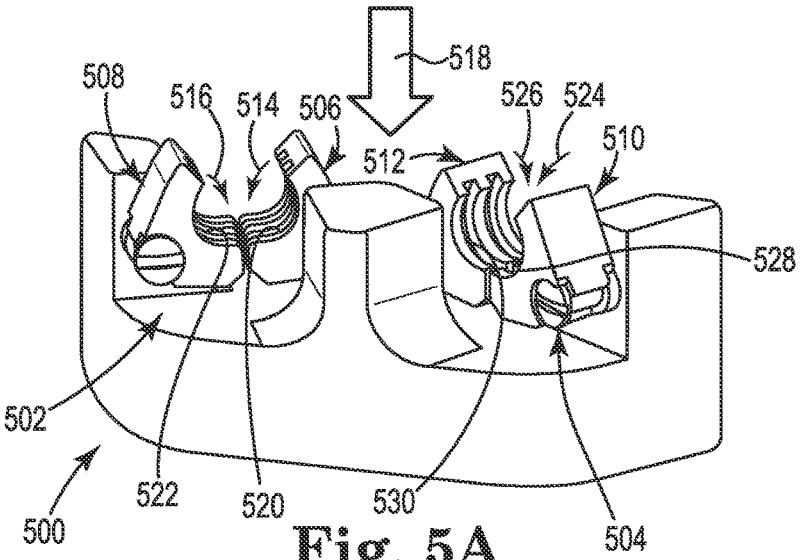
FIG. 5A is a partial front perspective view of a tube retention device, as seen from the outside of a roller pump head within which the tube retention device is configured to be removably disposed, in which an illustrated clamp is in a first (open) position, in accordance with embodiments of the subject matter disclosed herein.
Figure 5B:
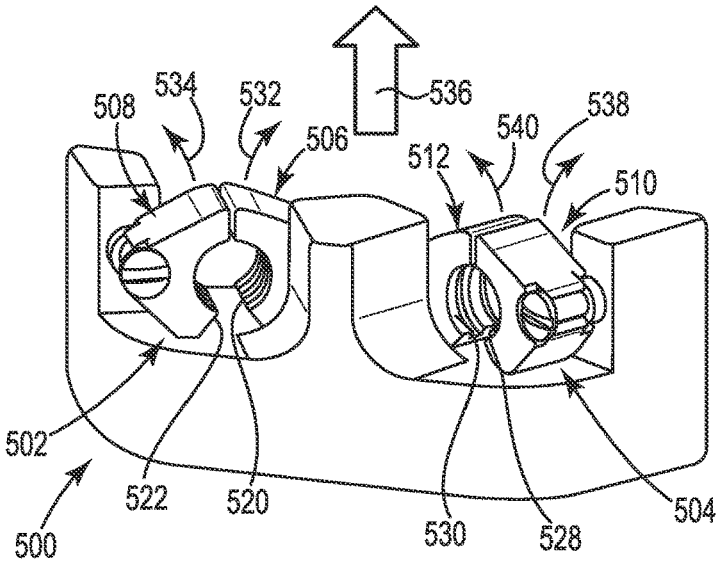
FIG. 5B is the same partial front perspective view of the tube retention device depicted in FIG. 5A, in which the clamp is in a second (closed) position, in accordance with embodiments of the subject matter disclosed herein.

FIGS. 5A and 5B depict operation of illustrative tube retention clamps, in accordance with embodiments of the subject matter disclosed herein. FIG. 5A is a partial front perspective view of a tube retention device 500, as seen from the outside of a roller pump head within which the tube retention device 500 is configured to be removably disposed, in which clamps 502 and 504 are in a first (open) position; and FIG. 5B is the same partial front perspective view of the tube retention device 500, in which the clamps 502 and 504 are in a second (closed) position, in accordance with embodiments of the subject matter disclosed herein. According to embodiments, the tube retention device 500 may be, or be similar to, the tube retention device 202 depicted in FIGS. 2A-2C, the tube retention device 300 depicted in FIGS. 3A-3H, the tube retention device 400 depicted in FIG. 4, and/or the like; and the clamps 502 and 504 may be, or be similar to, any one or more of the clamps 226A and 226B depicted in FIGS. 2A-2C, the clamps 326 and 328 depicted in FIGS. 3A-3D, the clamps 404 and 406 depicted in FIG. 4, and/or the like.

As shown in FIG. 5A, the clamps 502 and 504 are in an open position, ready to receive a tube piece (not shown). Retention of the tube piece by the clamps 502 and 504 may be accomplished by simply pressing the tube piece down onto the clamps 502 and 504. That is, for example, according to embodiments, each of the clamp components 506 and 508 of the clamp 502 may be configured to rotate, in a first and second direction 514 and 516, respectively, in response to application of force, in the downward direction 518, by a tube piece (not shown) upon the respective tube-engagement surfaces 520 and 522, such that the clamp 502 transitions from an open position (shown in FIG. 5A) to a closed position (shown in FIG. 5B). Similarly, according to embodiments, each of the clamp components 510 and 512 of the clamp 504 may be configured to rotate, in a third and fourth direction 524 and 526, respectively, in response to application of force, in the downward direction 518, by a tube piece (not shown) upon the respective tube-engagement surfaces 528 and 530, such that the clamp 504 transitions from an open position (shown in FIG. 5A) to a closed position (shown in FIG. 5B).

Similarly, as shown in FIG. 5B, to remove the tube piece from the clamp 502 or the clamp 504, the tube piece may be pulled upward out of the clamp 502 or the clamp 504, respectively. That is, for example, according to embodiments, each of the clamp components 506 and 508 of the clamp 502 may be configured to rotate, in a fifth and sixth direction 532 and 534, respectively, in response to application of force, in the upward direction 536, by the tube piece upon the respective tube-engagement surfaces 520 and 522, such that the clamp 502 transitions from a closed position (shown in FIG. 5B) to an open position (shown in FIG. 5A). Similarly, each of the clamp components 510 and 512 of the clamp 504 may be configured to rotate, in a seventh and eighth direction 538 and 540, respectively, in response to application of force, in the upward direction 536, by the tube piece upon the respective tube-engagement surfaces 528 and 530, such that the clamp 504 transitions from a closed position (shown in FIG. 5B) to an open position (shown in FIG. 5A).

The illustrative tube retention device 500, and clamps 502 and 504, shown in FIGS. 5A and 5B are not intended to suggest any limitation as to the scope of use or functionality of embodiments of the present disclosure. The illustrative tube retention device 500, and clamps 502 and 504, should not be interpreted as having any dependency or requirement related to any single component or combination of components illustrated therein. Additionally, various components depicted in FIGS. 5A and 5B may be, in embodiments, integrated with various ones of the other components depicted therein (and/or components not illustrated), all of which are considered to be within the ambit of the subject matter disclosed herein.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the described features. In embodiments, for example, the tube-retention device may include a sensor system configured to detect whether a clamp (e.g., clamp components) are in the open or closed position. The sensor system may include any number of different types of sensors such as, for example, mechanical sensors, optical sensors, and/or the like. Accordingly, the scope of the present disclosure is intended to embrace all such alternatives, modifications, and variations as fall within the scope of the claims, together with all equivalents thereof.

I claim:

1. A tube retention device, comprising:

a tube retention block having a first wall surface defining a first plane and a second wall surface defining a second plane different from the first plane, the first wall surface facing the second plane, and the first and second wall surfaces comprising a first attachment point and a second attachment point, respectively;

a first clamp component having a first tube-engagement surface, wherein the first clamp component is pivotably coupled to only the first wall surface at only the first attachment point, and wherein the first clamp component is configured to rotate about an axis at least approximately normal to the first wall surface at the first attachment point; and a second clamp component having a second tube-engagement surface, wherein the second clamp component is pivotably coupled to only the second wall surface at only the second attachment point, and wherein the second clamp component is configured to rotate about an axis at least approximately normal to the second wall surface at the second attachment point; and wherein the first and second clamp components are configured to rotate, in opposite directions and in response to application of force by a tube piece upon the first and second tube-engagement surfaces, from an open position to a closed position, wherein the tube piece is retained between the first and second clamp components when the first and second clamp components are in the closed position.

2. The tube retention device of claim 1, wherein the first tube-engagement surface is curved to correspond to a curve of an outer surface of the tube piece.

3. The tube retention device of claim 2, wherein the first tube-engagement surface comprises at least one grip feature.

4. The tube retention device of claim 3, the at least one grip feature comprising a plurality of grooves defined within the first tube-engagement surface.

5. The tube retention device of claim 4, wherein the second tube-engagement surface comprises an additional plurality of grooves defined therein, and wherein the plurality of grooves defined within the first tube-engagement surface and the additional plurality of grooves defined within the second tube-engagement surface are configured to interface so that the first and second clamp components, when in the closed position, form a retention interface that extends at least approximately around the entire perimeter of the tube piece.

6. The tube retention device of claim 1, further comprising a limit stop configured to prevent at least one of the first and second clamp components from rotating further than the closed position.

7. The tube retention device of claim 1, further comprising a guide system configured to synchronize the rotation of the first and second clamp components.

8. The tube retention device of claim 1, further comprising a position-maintaining mechanism configured to maintain the first and second clamp components in the open position until acted upon by the tube piece.

9. The tube retention device of claim 1, further comprising a locking mechanism configured to facilitate locking the first and second clamp components in the open position and/or the closed position.

10. The tube retention device of claim 1, further comprising a sensor system configured to detect whether the first and second clamp components are in the open or closed position.

11. A tube retention device, comprising:

a tube retention block having a first wall surface defining a first plane and a second wall surface defining a second plane different from the first plane, the second wall surface facing the first plane, the first and second wall surfaces comprising a first attachment point and a second attachment point, respectively;

a first clamp component having a first tube-engagement surface and a first pivot couple surface, wherein the first pivot couple surface is configured to engage only a first pivot pin, wherein the first pivot pin is coupled only to the first attachment point such that the first clamp component is configured to rotate about the first pivot pin; and a second clamp component having a second tube-engagement surface and a second pivot couple surface, wherein the second pivot couple surface is configured to engage only a second pivot pin, wherein the second pivot pin is coupled only to the second attachment point such that the second clamp component is configured to rotate about the second pivot pin, wherein the first clamp component is configured to rotate, in a first direction and in response to application of force by a portion of a tube piece upon the first tube-engagement surface, from an open position to a closed position, wherein the second clamp component is configured to rotate, in a second direction that is opposed to the first direction and in response to application of force by the portion of the tube piece upon the second tube-engagement surface, from an open position to a closed position, and wherein the portion of the tube piece is retained between the first and second clamp components when the first and second clamp components are in the closed position.

12. The tube retention device of claim 11, the tube retention block further comprising a third wall surface and a fourth wall surface, the third and fourth wall surfaces comprising a third attachment point and a fourth attachment point, respectively, the device further comprising:

a third clamp component having a third tube-engagement surface and a third pivot couple surface, wherein the third pivot couple surface is configured to engage a third pivot pin, wherein the third pivot pin is coupled to the third attachment point such that the third clamp component is configured to rotate about the third pivot pin; and a fourth clamp component having a fourth tube-engagement surface and a fourth pivot couple surface, wherein the fourth pivot couple surface is configured to engage a fourth pivot pin, wherein the fourth pivot pin is coupled to the fourth attachment point such that the fourth clamp component is configured to rotate about the fourth pivot pin, wherein the third and fourth clamp components are configured to rotate, in opposite directions and in response to application of force by an additional portion of the tube piece upon the third and fourth tube-engagement surfaces, from an open position to a closed position, wherein the additional portion of the tube piece is retained between the third and fourth clamp components when the third and fourth clamp components are in the closed position.

13. The tube retention device of claim 12, wherein the tube retention block comprises a base configured to be disposed within an opening to a pump head of a roller pump, and wherein the first wall surface is disposed on a first pillar extending upward from an upper surface of the base.

14. The tube retention device of claim 13, wherein the second wall surface is disposed on a second pillar extending upward from the upper surface of the base.

15. The tube retention device of claim 11, wherein the first tube-engagement surface is curved to correspond to a curve of an outer surface of the tube piece.

16. The tube retention device of claim 15, wherein the first tube-engagement surface comprises at least one grip feature.

17. The tube retention device of claim 16, the at least one grip feature comprising a plurality of grooves defined within the first tube-engagement surface, wherein the second tube-engagement surface comprises an additional plurality of grooves defined therein, and wherein the plurality of grooves defined within the first tube-engagement surface and the additional plurality of grooves defined within the second tube-engagement surface are configured to interface so that the first and second clamp components, when in the closed position, form a retention interface that extends at least approximately around the entire perimeter of the tube piece.

18. A roller pump, comprising:

a pump head having an opening defined therein; and a tube retention device disposed at the opening, the tube retention device comprising:

a first wall surface, a second wall surface, a third wall surface, and a fourth wall surface, the first, second, third, and fourth wall surfaces comprising a first attachment point, a second attachment point, a third attachment point, and a fourth attachment point, respectively, wherein the first and second wall surfaces define first and second different planes, respectively, and the first wall surface faces the second plane;

a first clamp component having a first tube-engagement surface, wherein the first clamp component is pivotably coupled to only the first wall surface at only the first attachment point, and wherein the first clamp component is configured to rotate about a first axis at least approximately normal to the first wall surface at the first attachment point;

a second clamp component having a second tube-engagement surface, wherein the second clamp component is pivotably coupled to only the second wall surface at only the second attachment point, and wherein the second clamp component is configured to rotate about a second axis at least approximately normal to the second wall surface at the second attachment point, wherein the first and second axes are parallel to one another, wherein the first and second clamp components are configured to rotate, in opposite directions and in response to application of force by a tube piece upon the first and second tube-engagement surfaces, from an open position to a closed position, wherein the tube piece is retained between the first and second clamp components when the first and second clamp components are in the closed position;

a third clamp component having a third tube-engagement surface and a third pivot couple surface, wherein the third pivot couple surface is configured to engage only a third pivot pin, wherein the third pivot pin is coupled to only the third attachment point such that the third clamp component is configured to rotate about the third pivot pin defining a third axis; and a fourth clamp component having a fourth tube-engagement surface and a fourth pivot couple surface, wherein the fourth pivot couple surface is configured to engage only a fourth pivot pin, wherein the fourth pivot pin is coupled to only the fourth attachment point such that the fourth clamp component is configured to rotate about the fourth pivot pin defining a fourth axis, wherein the third and fourth axes are parallel to one another, wherein the first and second axes are at an angle to the third and fourth axes, wherein the third and fourth clamp components are configured to rotate, in opposite directions and in response to application of force by an additional portion of the tube piece upon the third and fourth tube-engagement surfaces, from an open position to a closed position, wherein the additional portion of the tube piece is retained between the third and fourth clamp components when the third and fourth clamp components are in the closed position.

19. The roller pump of claim 18, the tube retention device further comprising a limit stop configured to prevent at least one of the first, second, third, and fourth clamp components from rotating further than the closed position.

20. The roller pump of claim 18, the tube retention device further comprising at least one position-maintaining mechanism configured to maintain the first, second, third, and fourth clamp components in the open position until acted upon by the tube piece.

* * * * *